US006344606B1

(12) United States Patent
Yamanoue

(10) Patent No.: US 6,344,606 B1
(45) Date of Patent: Feb. 5, 2002

(54) TONE GENERATION DEVICE AND TONE GENERATION METHOD, AND DISTRIBUTION MEDIUM THEREFOR

(75) Inventor: Kaoru Yamanoue, Tokyo (JP)

(73) Assignee: Sony Computer Entertainment, Inc., Tokyo (JP)

( * ) Notice: Subject to any disclaimer, the term of this patent is extended or adjusted under 35 U.S.C. 154(b) by 0 days.

(21) Appl. No.: 09/466,636

(22) Filed: Dec. 17, 1999

(30) Foreign Application Priority Data

Dec. 17, 1998 (JP) ..... 10-358796

(51) Int. Cl.[7] ..... G10H 7/00

(52) U.S. Cl. ..... 84/604; 84/600; 84/622; 84/659

(58) Field of Search ..... 84/600–606, 615, 84/622–625, 659–660

(56) References Cited

U.S. PATENT DOCUMENTS 5,119,710 A 6/1992 Tsurumi et al.
5,376,752 A 12/1994 Limberis et al.
5,728,961 A * 3/1998 Tamura ..... 84/600

FOREIGN PATENT DOCUMENTS

EP 0747878 A2 12/1996

* cited by examiner

*Primary Examiner*—Marlon T. Fletcher
(74) *Attorney, Agent, or Firm*—Rosenman & Colin LLP

(57) ABSTRACT

A tone generation device includes a computation unit which consists of multiple computation devices, a sheet music data analysis unit which reads data from a sheet music data holding unit and a waveform data holding unit and computes the sum total of the amount of processing based on this data. The tone generation device further includes a computation processing allocation instruction unit, a computation unit processing procedure holding unit and a processing routine holding unit. Based on the computed sum total of the amount of processing, the computation unit processing allocation instruction unit determines the amount of processing for each computation device so that it is an amount of processing that matches the capacity of each computation device, and sets a processing procedure in accordance with the determined amounts of processing. The set processing procedure is held in the computation unit processing procedure holding unit. Each computation device of the computation unit generates tones in accordance with the procedure held in the computation unit processing procedure holding unit and the routine held in processing routine holding unit.

6 Claims, 8 Drawing Sheets

TONE GENERATION DEVICE

TONE GENERATION DEVICE

TONE GENERATION DEVICE

TIMBRE 1: LOUDNESS CHANGE WITH HIGH COMPRESSION/SMALL AMOUNT OF PROCESSING

TIMBRE 2: LOUDNESS CHANGE WITH LOW COMPRESSION/LINGERING TONE AFTER SILENCING, AND LARGE AMOUNT OF PROCESSING

TIMBRE 3: LOUDNESS CHANGE WITH LOW COMPRESSION/LINGERING TONE AFTER SILENCING, AND LARGE AMOUNT OF PROCESSING

TONE GENERATION DEVICE

TONE GENERATION DEVICE AND TONE GENERATION METHOD, AND DISTRIBUTION MEDIUM THEREFOR

BACKGROUND OF THE INVENTION

1. Field of the Invention

The present invention relates to a tone generation device and method, and a distribution medium. More specifically, the invention relates to a tone generation device and tone generation method that compute the amount of data processing needed for generating tones and apportion the processing among multiple computation devices based on the computed amount of processing, and a distribution medium.

2. Description of the Prior Art

In a conventional tone generation device, tones have been generated by using a computation device that can previously estimate the amount of processing for the data to be processed and can process that amount of processing.

Alternatively, tones containing a great deal of information have been generated by using multiple computation devices, predetermining the content that each computation device shall process, and executing in parallel the processing predetermined for each computation device.

However, a computation device capable of processing sufficient data was generally expensive, and in some cases the amount of data to be processed was so great that no computation devices have been available that were able to process it. And even if multiple computation devices were used, depending on the content of the data, sometimes the amount of processing preassigned to a computation device exceeds its capacity, which has created the problem that in that case the data cannot be processed even if multiple computation devices are used.

SUMMARY OF THE INVENTION

It is an object of the present invention to make it possible for each computation device to process data efficiently, by computing the amount of processing from the data to be processed, apportioning the amount of processing in accordance with the capacity of each computation device, and doing tone generation processing.

To attain the above and other objects of the invention a tone generation device has been suggested, which comprises a reading means that reads data for generating tones, a computation means that computes the amount of processing needed to generate the tones of the data read by the reading means, multiple generation means that generate tones, and an apportioning means that apportions the processing for generating tones to multiple generation means according to the amount of processing computed by the computation means.

The tone generation device of this invention may further comprise a decision means that decides whether the amount of processing computed by the computation means can be processed by one of the generation means among the multiple generation means, and if it is decided by the decision means that the amount of processing computed by the computation means is an amount that can be processed by one generation means, the apportioning means apportions all of the computed amount of processing to one generation means, and if it is decided by the decision means that it is not an amount that can be processed by one generation means, the apportioning means apportions the processing to multiple generation means in correspondence with the capacity of each generation means in accordance with the computed amount of processing.

Objects of the present invention are also attained by a tone generation method comprising a reading step that reads data for generating tones, a computation step that computes the amount of processing needed to generate the tones of the data read in the reading step, multiple generation steps that generate tones, and an apportioning step that apportions the processing for generating tones to multiple generation steps according to the amount of processing computed in the computation step.

A distribution medium of the present invention provides a computer-readable program that causes the tone generation device to execute processing that includes a reading step that reads data for generating tones, a computation step that computes the amount of processing needed to generate the tones of the data read in the reading step, multiple generation steps that generate tones, and an apportioning step that apportions the processing for generating tones to multiple generation steps according to the amount of processing computed in the computation step.

With tone generation device, tone generation method, and distribution medium of the present invention, data for generating tones is read, the amount of processing needed for generating the tones of the read data is computed, and processing for generating tones in accordance with the computed amount of processing is apportioned to multiple devices for generating tones.

The tone generation device of this invention may comprise multiple generation means that generate tones, a first reading means that reads data describing the processing procedure assigned to each of multiple generation means determined based on the amount of processing of data for generating tones, and a second reading means that reads data for generation means to generate tones in accordance with the processing procedure read by the first reading means.

The tone generation method of the invention may comprise multiple generation steps that generate tones, a first reading step that reads data describing the processing procedure assigned to each in the multiple generation steps determined based on the amount of processing of data for generating tones, and a second reading step that reads data to generate tones in the generation steps in accordance with the processing procedure read in the first reading step.

In an embodiment the distribution medium of the present invention provides a computer-readable program that causes the tone generation device to execute processing that includes multiple generation steps that generate tones, a first reading step that reads data describing the processing procedure assigned to each in the multiple generation steps determined based on the amount of processing of data for generating tones, and a second reading step that reads data to generate tones in the generation steps in accordance with the processing procedure read in the first reading step.

With the tone generation device, tone generation method, and distribution medium of the present invention, data describing the processing procedure assigned to each of multiple processing units determined based on the amount of processing of data for generating tones is read, and data for generating tones is read in accordance with the read processing procedures.

DETAILED DESCRIPTION OF THE PREFERRED EMBODIMENTS

Figure 1:
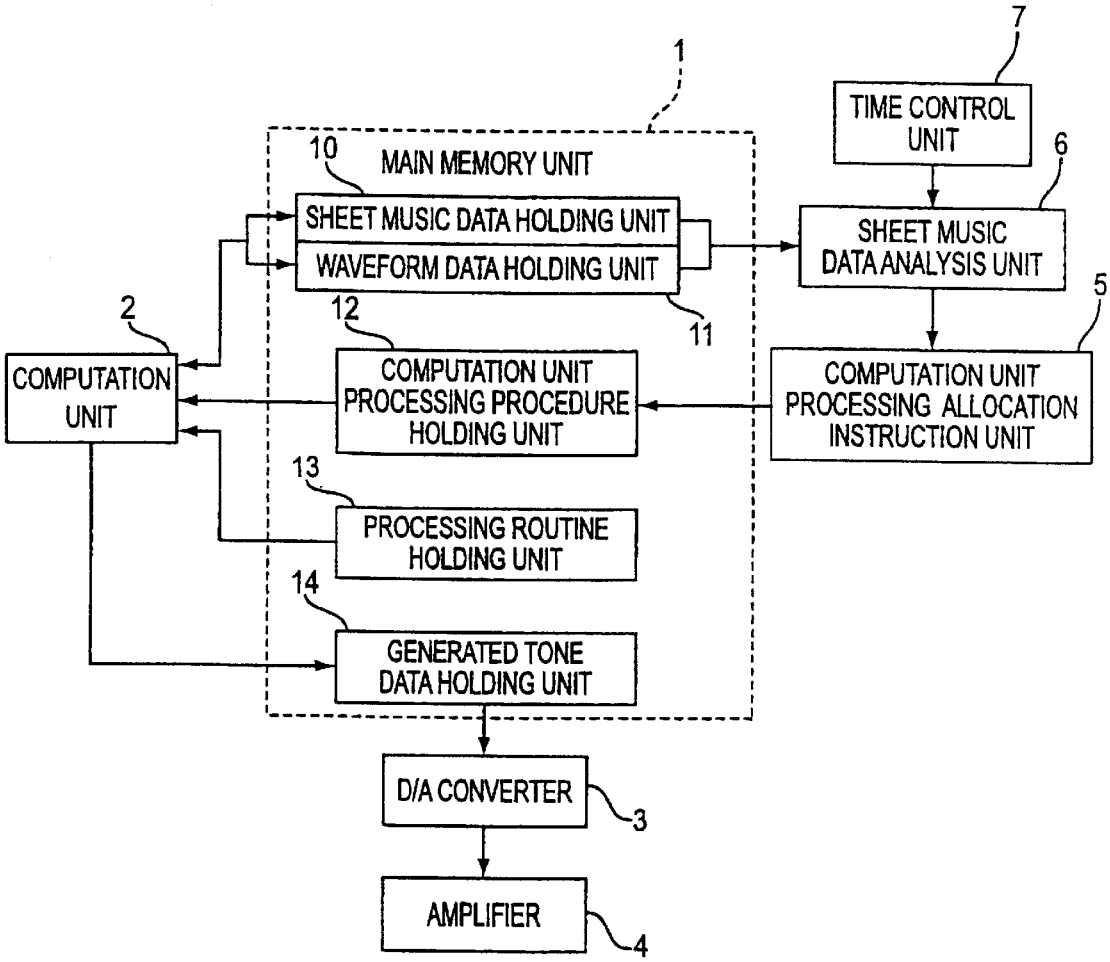
FIG. 1 is a block diagram of an embodiment of the tone generation device of the present invention.

Referring now to the drawings in detail.

FIG. 1 is a block diagram showing an embodiment of the tone generation device of this invention. A computation unit 2 consists of multiple computation devices (DSPs 2*a* and 2*b* shown in FIG. 3 as described below). A main memory unit 1 includes a sheet music data holding unit 10 which holds the sheet music data read from a CD-ROM or other recording medium (not shown), a waveform data holding unit 11 which holds waveform data, a computation unit processing procedure holding unit 12 which holds the processing procedure for computing with each computation device of computation unit 2, a processing routine holding unit 13 which holds the specific processing routine needed when a tone is generated, and a generated tone data holding unit 14 which holds the tone that has been generated.

Here, "sheet music data" is data concerning sheet music, and is the data indicating that a prescribed sound is to be played at a prescribed tempo on a prescribed musical instrument. The waveform data is data concerning the waveform of a specified pitch (for example, "do") of a musical instrument specified by the sheet music data. Other pitches are generated based on this specified pitch by the pitch transformations discussed below.

Connected to main memory unit 1 is a sheet music data analysis unit 6. The sheet music data analysis unit 6 makes an analysis of the amount of processing to be done by computation unit 2 based on data concerning the sheet music held in sheet music data holding unit 10 and data concerning the timbre held in waveform data holding unit 11, and outputs the results of its analysis to a computation unit processing allocation instruction unit 5. Computation unit processing allocation instruction unit 5 makes an allocation of the processing to be done by each computation device of computation unit 2 based on data of the analysis results of the amount of processing that has been input. A time control unit 7 gives timing instructions to sheet music data analysis unit 6 for when to begin analysis (read data).

The allocation results determined by computation unit processing allocation instruction unit 5 are output to and held in computation unit processing procedure holding unit 12 of main memory unit 1. Computation unit 2 generates tones using the data held in sheet music data holding unit 10, waveform data holding unit 11, computation unit processing procedure holding unit 12, and processing routine holding unit 13. The generated tones are held in generated tone data holding unit 14 of main memory unit 1.

The data held in generated tone data holding unit 14 is output to an D/A (digital/analog) converter 3, and digital data is converted to analog data and is output to amplifier 4. Amplifier 4 amplifies the analog data that is input, and outputs it to a speaker, etc. (not shown).

Here the data to be analyzed by sheet music data analysis unit 6 will be explained. The data to be analyzed includes a simultaneous tone emission number, a compression waveform data, musical interval changes, and loudness changes.

First is the simultaneous tone emission number, which is data for analyzing differences in the amount of processing that arises depending on the number of tones to be emitted simultaneously. For example, if the notes do, mi, and sol are to be emitted simultaneously, even with the same timbre, then the simultaneous tone emission number is 3 tones. In this case, the processing beginning with stretch processing of the waveform data (discussed below) grows linearly with the number of these simultaneous tone emission numbers (different intervals). If the different timbres are to be sounded with three instruments, such as a piano, violin, and guitar, then the simultaneous tone emission number is 3 tones, even if it is the same sound do. In this case too, processing beginning with stretch processing of the waveform data grows with the number of simultaneous tone emission numbers (timbres).

The compression waveform data is data for analyzing the amount of processing generated by differences in the compression method for each waveform data. Sounds where high sound quality is required are either not compressed or are compressed by a method with a low compression ratio. Thus it suffices to have a small amount of processing when doing stretching. Conversely, a sound where high sound quality is not required is compressed by a method with a high compression ratio, so the amount of processing when this stretching is done becomes large.

An interval (pitch) change is data for analyzing the amount of processing that arises due to changes in the processing that arises depending on how high or low the interval (pitch) is. When a change is made to a higher interval, the amount of waveform data required per unit time is necessarily larger than if the tone is emitted with the interval of the fundamental tone (meaning the tone that serves as the base for changing the interval). For example, on a cassette tape recorder, if fast forward is done (if more data than usual is generated per unit time), the tone will sound as if it has become higher. This demonstrates that in order to change a tone in the higher direction, it is necessary to read the data that lies ahead. Because advance data is read, more data is generated than if sound were emitted at the fundamental tone, and a longer time is needed than for that processing. Conversely, if a tone is to be emitted that is lower than the fundamental tone, one does not require as much data as in the case where it is emitted at the fundamental tone.

Figure 2A:
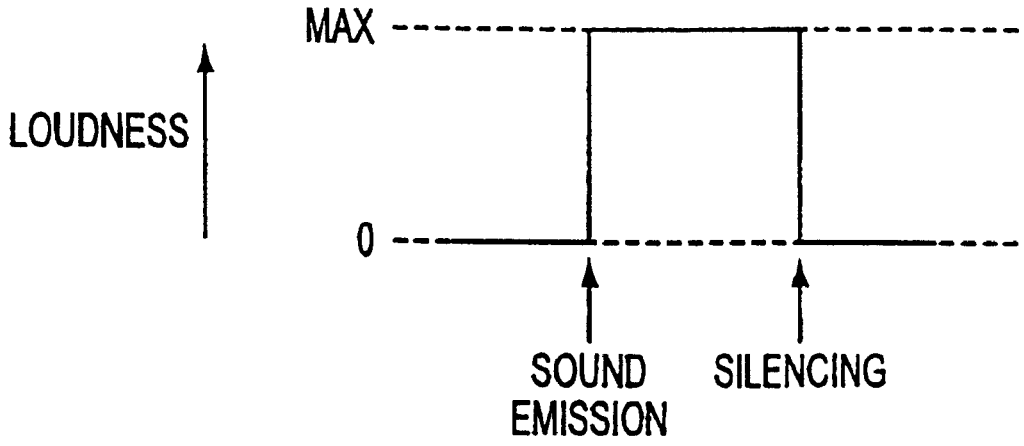
FIG. 2A and 2B are diagrams for explaining how timbre is changed by change in loudness.
Figure 2B:
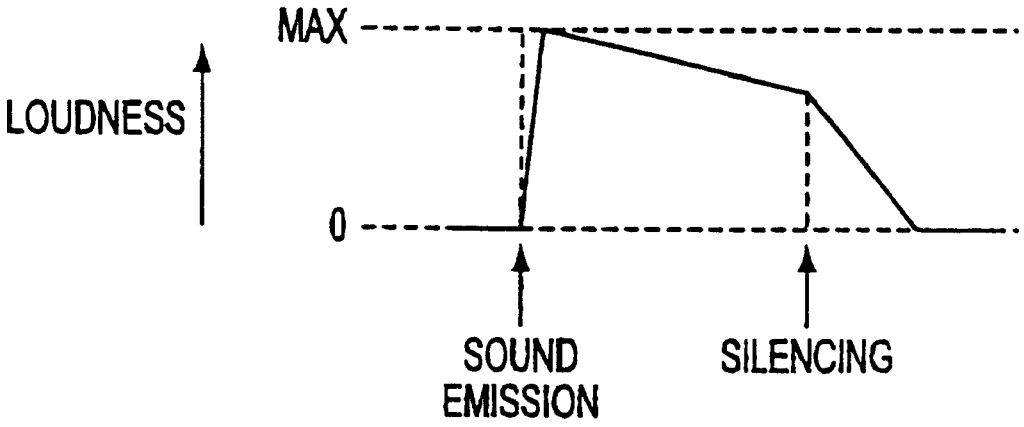

A loudness (envelope) change is data for analyzing the amount of processing that arises due to differences between musical instruments (timbre differences). To change the timbre of a tone of the same interval, it suffices to change the loudness of the sound emission and silencing. For example, only a small amount of processing is needed for a timbre (for example, an organ) where, as shown in FIG. 2A, the loudness reaches its maximum value immediately after the tone begins, a fixed loudness continues, then, when the tone ends, its loudness immediately reaches its minimum value (falls silent). Conversely, the amount of processing becomes large for a timbre (for example, a piano) where, as shown in FIG. 2B, after the tone begins, it reaches its maximum loudness gradually, attenuates for a time, then, after the tone ends, its loudness gradually reaches its minimum.

Figure 3:
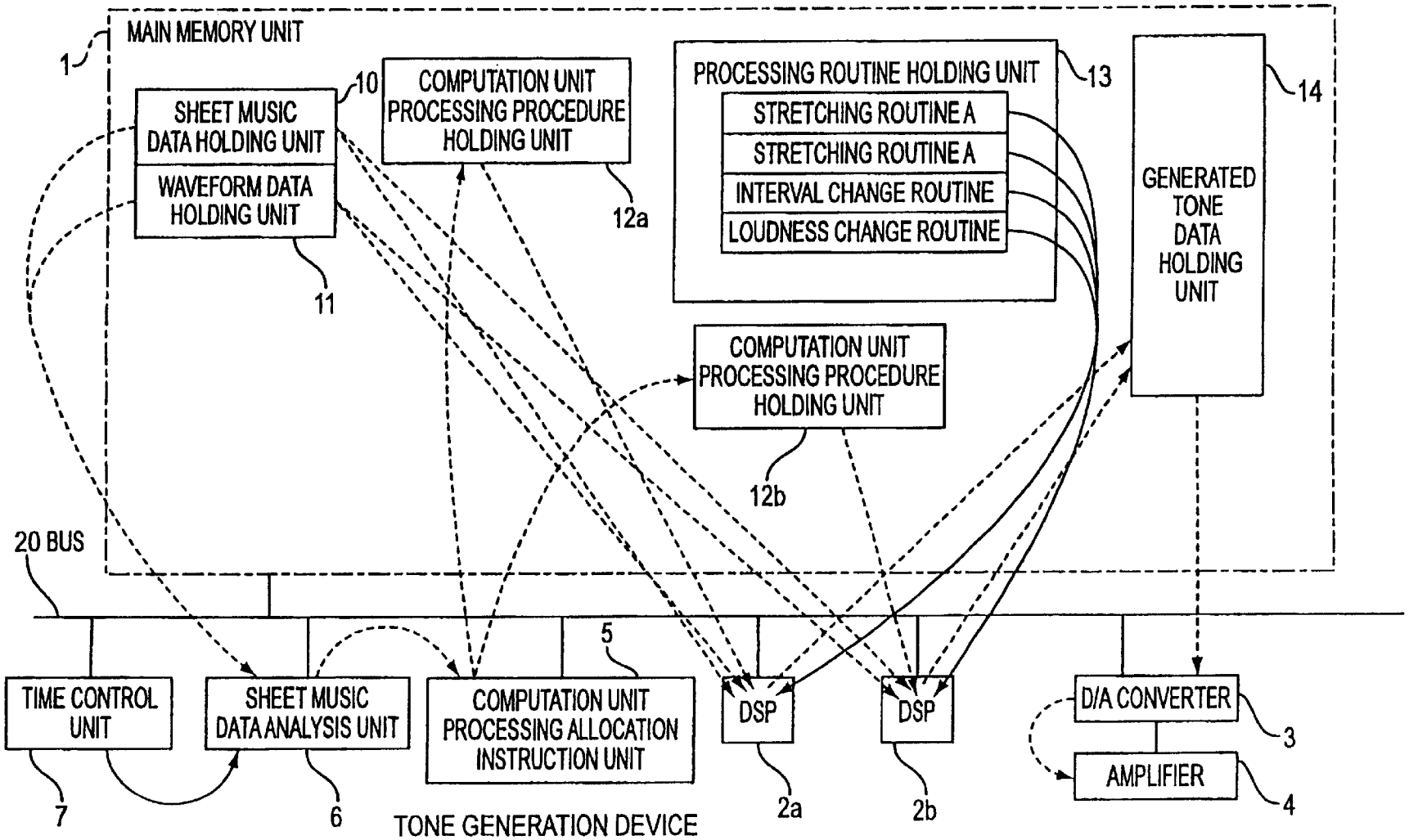
FIG. 3 is a diagram for explaining the flow of data of the tone generation device of the present invention.

With reference to FIG. 3, the method will be described by which the amount of processing for each computation unit is determined based on the above data. In the example of FIG. 3, two DSPs (digital signal processors) 2*a* and 2*b* are used as computation unit 2, and provided along with them are computation unit processing procedure holding unit 12*a*, which holds the computation processing procedure corresponding to DSP 2*a*, and computation unit processing procedure holding unit 12*b*, which holds the computation processing procedure corresponding to DSP 2*b*. In FIG. 3, the flow of data is indicated by arrows.

Also, main memory unit 1, DSPs 2*a* and 2*b*, D/A converter 3, computation unit processing allocation instruction unit 5, sheet music data analysis unit 6, and time control unit 7 are connected to each other by a bus 20 so that they can exchange data with each other. The data output from D/A converter 3 is input into amplifier 4.

In the following description, the amount of processing executed by DSPs 2*a* and 2*b* is expressed in points, and the processing capacity of DSPs 2*a* and 2*b* is taken to be 150 points. For the aforesaid waveform data stretching, interval processing, and loudness changes, the amount of processing for each is computed, and the amount of processing to be done by DSPs 2*a* and 2*b* is set according to this number of points. The simultaneous tone emission number is used for computation of the amount of processing for interval changes and loudness changes, and the amount of processing for the simultaneous tone emission number itself is not computed.

First, the computation of the amount of processing for waveform data stretching will be described. If there is a start of the tone at an interval higher than the interval of the fundamental tone (the tone do) and the range of intervals of tone emission using the same waveform data is within n octaves, then the amount of processing per unit time is computed by the following formula.

If high-compression waveform data: amount of processing= $10\times2^n$ (1)

If low-compression waveform data: amount of processing= $5\times2^n$ (2)

If it is a tone emission at an interval that is lower than the fundamental tone, then the amount of processing is computed by the following formula, regardless of the range of its intervals.

If high-compression waveform data: amount of processing=10 (3)

If low-compression waveform data: amount of processing=5 (4)

Next, we describe the computation of the amount of processing for an interval change will be described. In this case, the amount of processing (number of points) becomes greater than the simultaneous tone emission number. That is, the amount of processing for an interval change is computed by using the following formula.

If a fundamental tone: amount of processing=0 (5)

If an interval lower than the fundamental tone: amount of processing=10×(simultaneous tone emission number) (6)

If an interval n octaves higher than the fundamental tone: amount of processing=10×(n+1)×(simultaneous tone emission number) (7)

The amount of processing (number of points) for a loudness change (envelope processing) is likewise greater than the simultaneous tone emission number, and its computation formula becomes as shown in the following formula.

If amount of processing is small: amount of processing=2×(simultaneous tone emission number) (8)

If amount of processing is large: =amount of processing=6×(simultaneous tone emission number) (9)

Figure 4:
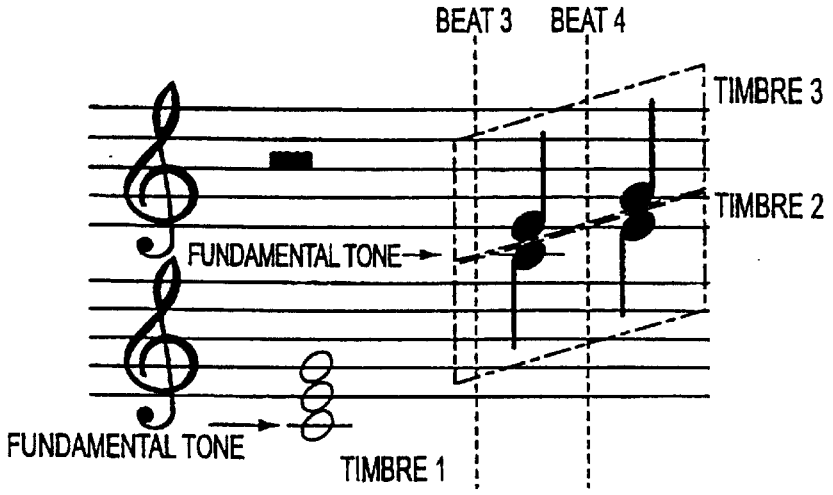
FIG. 4 is a diagram for explaining sheet music data.

FIG. 4 shows an example of sheet music handled as sheet music data. The features of these timbres 1 through 3 are as follows.

| | | |
|---|---|---|
| Timbre 1: | Waveform data: | high compression |
| | Loudness change: | amount of processing is small |
| Timbre 2: | Waveform data: | low compression |
| | Loudness change: | amount of processing is large |
| | There is a lingering tone after the end of the tone | |
| Timbre 3: | Waveform data: | low compression |
| | Loudness change: | amount of processing is large |
| | There is a lingering tone after the end of the tone | |

The fundamental tone of these timbres 1 through 3 (the tone whose standard is held in waveform data holding unit 11) is in each case taken to be the tone do.

As shown in the sheet music of FIG. 4, the three tones of timbre 1 (do, mi, sol) begin simultaneously at the first beat at the start, they are continued until the fourth beat (sustained tones), one tone (do) of timbre 2 and one tone (mi) of timbre 3 begin at the third beat, their tones are emitted sustained until the fourth beat (because a tone lingers even after the end of the tone), and one tone (mi) of timbre 2 and one tone (sol) of timbre 3 are emitted at the fourth beat. That is, three tones are expressed simultaneously at the first and second beats, five tones at the third beat, and seven tones at the fourth beat.

Taking as an example the case in which the amount of processing of the sheet music data is as shown in FIG. 4, the operation of the tone generation device shown in FIG. 3 is described with reference to the flowchart in FIG. 5. First, in step S1, time control unit 7 informs sheet music data analysis unit 6 of the timing of the data reading from sheet music data holding unit 10 and waveform data holding unit 11. Based on this notified timing, in step S2, sheet music data analysis unit 6 reads the first-beat data from sheet music data holding unit 10 and waveform data holding unit 11 and begins analysis of data it has read.

The do, mi, sol of timbre 1 are emitted simultaneously on the first beat. Both mi and sol are higher than the do tone which is the fundamental tone, and they are tones within one octave (that is, n=1). Also, the waveform data of timbre 1 is highly compressed. From the foregoing, first, the amount of processing for waveform stretching is computed using formula (1) as shown in the following formula.

$$10\times2^1=20 \quad (10)$$

The change in volume is computed as shown in the following formula.

$$(0\times1)+(10\times(1+1)\times2)=40 \quad (11)$$

The first term of this formula is the amount of processing for the do tone, so the computation is done using formula (5), and the second term is the amount of processing for the mi and sol tones, so the computation is done using formula (7). In the second term, the value of n is 1, and the amount of processing is computed taking the simultaneous tone emission number as 2 (mi and sol).

The change in loudness is computed as shown in the following formula.

$$2\times3=6 \quad (12)$$

For timbre 1, the amount of processing is small, so the amount of processing is computed using formula (8). Also, the simultaneous tone emission number is set to the 3 tones do, mi, sol.

From the above results, 66 points, which is the sum of the points of formulas (10) through (12), becomes the amount of processing for timbre 1. This amount of processing is sent from sheet music data analysis unit 6 to computation unit processing, allocation instruction unit 5.

In step S3, sheet music data analysis unit 10 moves the reading pointer to the data held in sheet music data analysis unit 10 to the position to be read at the next timing. In the present case, the reading pointer is moved to the start of the sheet music data for the second beat.

In step S4, computation unit processing allocation instruction unit 5 decides whether the sum of the amounts of processing computed in step S2 is an amount that can be processed by one of the DSPs, either 2*a* or 2*b*. In the present case, the maximum value of the amount of processing that can be processed by one DSP 2*a* or 2*b* is 150 points, and the total of the amounts of processing computed in step S2 is 66 points, so it is decided that it is an amount of processing that can be processed by one or the other of DSP 2*a* or 2*b*, and therefore one proceeds to step S7.

In step S7, the setting of all the processing procedures is done in computation unit processing procedure holding unit 12*a* of one DSP (here, set to DSP 2*a*). In the present case, the set processing procedure is the processing procedure in which the tones do, mi, sol are emitted simultaneously in timbre 1.

In step S8, DSP 2*a* processes the sheet music data and waveform data, and generates a tone, in accordance with the processing procedure held in computation unit processing procedure holding unit 12*a*. This sheet music data and waveform data have been read by sheet music data analysis unit 6 at the time when the amount of processing is computed in step S2. Sheet music data analysis unit 6 transmits all this data, together with the computed amount of processing, to computation unit processing allocation instruction unit 5, and computation unit processing allocation instruction unit 5 in turn transmits the data, together with the set processing procedure, to computation unit processing procedure holding units 12*a* and 12*b*. DSPs 2*a* and 2*b* generate a tone using this transmitted data.

Alternatively, sheet music data analysis unit 6 transmits to computation unit processing allocation instruction unit 5 only the sum of the computed amounts of processing, and computation unit processing allocation instruction unit 5 transmits only the set processing procedure to computation unit processing procedure holding units 12*a* and 12*b*, so as to cause them to store this information. It may also be arranged that in accordance with the processing procedure held in the corresponding computation unit processing procedure holding units 12*a* and 12*b*, DSPs 2*a* and 2*b* as necessary read data from sheet music data holding unit 10 and waveform data holding unit 11, process it, and generate tones.

When the tone is to be generated, a processing routine is supplied to DSPs 2*a* and 2*b* from processing routine holding unit 13. Typical such supplied processing routines are stretching routine A, which is used when stretching high-compression waveform data, stretching routine B, which is used when stretching low-compression waveform data, an interval change routine, which is used when changing a musical interval based on the fundamental tone, and a loudness change (envelope processing) routine, which is used when changing the timbre.

In step S8, tone data generated by DSP 2*a* is transmitted to and held in generated tone data holding unit 14. As necessary, the held tone data is transmitted to D/A converter 3, converted from digital data to analog data, and is then transmitted in turn to amplifier 4, and after it has been amplified, is output to a speaker, etc. (not shown).

In step S9, sheet music data analysis unit 6 waits to be informed, from time control unit 7, of the instructions for the timing for the reading of data (wait state). Then one goes back to step S1 and repeats the processing that begins there. That is, in this case, first, in step S1, the timing for reading the data for the second beat is done from time control unit 7 to sheet music data analysis unit 6. Then, as processing in response to this notification, sheet music data analysis unit 6, in step S2, reads the data for the tone of the second beat from sheet music data holding unit 10 and waveform data holding unit 11.

Sheet music data analysis unit 6 analyzes the data concerning the second-beat tone that has been read and computes its amount of processing. At the second beat, the do, mi, sol that were simultaneously initiated in timbre 1 continue to be sounded (a sustained tone). Therefore the number of points of its amount of processing remains the same. In step S3, the reading pointer of sheet music data holding unit 10 is moved to the sheet music data for the third beat. The flow of processing beginning at step S4 is the same flow as for the first beat, which has already been described, so its description is omitted.

Returning again to step S1, when time control unit 7 informs sheet music data analysis unit 6 of the timing for the reading of data for the third beat, in accordance with this timing, sheet music data analysis unit 6, in step S2, reads the data concerning the third beat from sheet music data holding unit 10 and waveform data holding unit 11. Then an analysis is made of the third-beat data that has been read, and its amount of processing is computed. In the third beat, five tones are sounded simultaneously: in addition to the sustained tone of timbre 1, the do tone of timbre 2 and the mi tone of timbre 3 are newly sounded simultaneously. In the following, the computation of the amount of processing for the newly sounded do tone of timbre 2 and mi tone of timbre 3 is described.

First, because the do tone of timbre 2 is low-compression, the amount of processing concerning stretching of the waveform data is computed using formula (2) as shown in the following formula. Also, the fundamental tone is treated as a high tone within one octave. Therefore formula (2) is used, and the amount of processing is computed with 1 as its n value.

$$5\times 2\hat{}1=10 \tag{13}$$

Also, for the interval change, the amount of processing is computed to be 0, using formula (5) because it is a fundamental tone. And for the loudness change, in view of the fact that timbre 2 is a loudness change with a large amount of processing and the simultaneous tone emission number is just timbre 2, it is just one tone, the do tone, so formula (8) is used, and the computation is made as shown in the following formula.

$$2\times 1=2 \tag{14}$$

By adding together the above computation results, the amount of processing for timbre 2 is computed to be 12 points.

The amount of processing for the mi tone of timbre 3 is computed in the same way. Being low-compression, the relevant formula for the amount of processing for the stretching of the waveform data is the same formula as formula (13), and the amount of processing is computed to be 10 points. Also, the amount of processing for the interval change is computed as shown in the following formula using formula (7), because it is the mi tone, which is a higher tone than the fundamental tone.

$$10\times(1+1)\times1=20 \quad (15)$$

Because the loudness change is one with a large amount of processing, the amount of processing for the loudness change is computed, by the same formula as formula (14), to be 2 points. Adding together the above results, the amount of processing for the mi tone of timbre 3 is determined to be 32 points.

Therefore the sum of the amounts of processing to be processed at the third beat is 110 points: 66 points for timbre 1, 12 points for timbre 2, and 32 points for timbre 3.

In step S3, the reading pointer of sheet music data holding unit 10 is moved to the position of the fourth beat. And in step S4, it is decided whether the total of 110 points as the amount of processing computed in step S2 can be processed by one DSP. Since 110 points is less than the 150-point amount of processing that can be processed by one DSP, it is decided that it can be processed by one DSP, and one proceeds to step S7. The processing that begins with step S7 has been described above, so the description thereof is omitted.

Returning again to step S1, when time control unit 7 informs sheet music data analysis unit 6 of the timing for the reading of data for the fourth beat, in accordance with this timing, sheet music data analysis unit 6, in step S2, reads the data concerning the fourth beat from sheet music data holding unit 10 and waveform data holding unit 11. An analysis is made of the data of the fourth beat, and its amount of processing is computed.

At the fourth beat, because of the sustained tone of timbre 1 and the lingering tones of timbres 2 and 3, a total of five tones is already being sounded, and besides these, the mi tone of timbre 2 and the sol tone of timbre 3 are newly being sounded, so that a total of seven tones is being sounded simultaneously. In the following, we describe the computation of the amount of processing for the newly sounded mi tone of timbre 2 and sol tone of timbre 3.

First, for the amount of processing for the stretching of the waveform data of timbre 2, formula (2) is used and the computation is made as shown in the following formula, because timbre 2 is low-compression and is a mi tone, which is higher than the fundamental tone.

$$5\times2\hat{}1=10 \quad (16)$$

Also, for the amount of processing for the interval change, formula (5) is used for the lingering tone do (fundamental tone) that is sounded at the third beat, formula (6) is used for the mi that is sounded at the fourth beat, and the computation is made as shown in the following formula.

$$(0\times1)+(10\times(1+1)\times1)=20 \quad (17)$$

Moreover, for the amount of processing for the loudness change, formula (9) is used because timbre 2 is a loudness change with a large amount of processing, and the computation is made as shown in the following formula. And in this case, for timbre 2 a total of two tones is being sounded simultaneously, namely the lingering tone of the do tone sounded at the third beat and the mi sounded at the fourth beat, so the simultaneous tone emission number is 2.

$$6\times2=12 \quad (18)$$

The 42-point total of the points of the above computation results (16) through (18) becomes the amount of processing for timbre 2.

The amount of processing is computed for timbre 3 in the same way. First, the amount of processing for the stretching of waveform data is computed as shown in the following formula using formula (2).

$$5\times2\hat{}1=10 \quad (19)$$

For the amount of processing for the interval change, formula (7) is used, and the computation is made as shown in the following formula.

$$10\times(1+1)\times2=40 \quad (20)$$

For the amount of processing for the loudness change, formula (9) is used, and the computation is made as shown in the following formula.

$$6\times2=12 \quad (21)$$

Therefore the 62-point total of the points of the above computation results (19) through (21) becomes the amount of processing for timbre 3.

Therefore the sum of the amounts of processing for the fourth beat is 170 points: 66 points for timbre 1, 42 points for timbre 2, and 62 points for timbre 3.

In step S3, the reading pointer of sheet music data holding unit 10 is moved to the position of the fifth beat.

In step S4, it is decided whether the total of 170 points as the amount of processing computed in step S2 can be processed by one DSP. In this case, the total number for the amount of processing is 170 points, so it is decided that it can be processed by one DSP, 2*a* or 2*b*, and one proceeds to step S5. In step S5, computation unit processing allocation instruction unit 5, taking one timbre as a unit so that a single timbre is not processed by two DSPs, divides the amount of processing so that the amount processed by DSPs 2*a* and 2*b* are equal.

If the total of 170 points of the amount of processing in this case is to be processed divided between the two DSPs 2*a* and 2*b*, the apportionment of the amount of processing can be done in the following three ways. In the following formulas, the first term is set to the amount of processing to be processed by DSP 2*a*, and the second term is set to the amount of processing to be processed by DSP 2*b*.

$$(\text{timbre 1}+\text{timbre 2})+\text{timbre 3}=(66+42)+62=108+62 \quad (22)$$

$$\text{timbre 1}+(\text{timbre 2}+\text{timbre 3})=66+(42+62)=66+104 \quad (23)$$

$$(\text{timbre 1}+\text{timbre 3})+\text{timbre 2}=(66+62)+42=128+42 \quad (24)$$

If the amount of processing is apportioned completely equally between DSP 2*a* and DSP 2*b*, the number of points becomes 85 (=170/2), which is the average value. But if the amount of processing is apportioned in one-timbre units, then as set forth above, it does not necessarily come to 85 points each. Computation unit processing allocation instruction unit 5 allocates the 170 points of amount of processing so that the amount of processing processed by DSPs 2*a* and 2*b*approaches 85 points each. Therefore computation unit processing allocation instruction unit 5 decides that allocation result (23) is the best allocation. That is, the 170 points of amount of processing is allocated so that the 66-point timbre 1 is processed by DSP 2*a* and the 104-point timbre 2 and timbre 3 are processed by DSP 2*b*.

In step S6, computation unit processing allocation instruction unit 5 sets the processing procedure for each of computation processing procedure holding units 12*a* and 12*b* according to the decided allocation results, and transmits the set processing procedure. In this case, computation unit processing allocation instruction unit 5 transmits to computation processing procedure holding units 12*a* a processing procedure that sounds as a sustained tone the do, mi, sol of timbre 1 to be processed by DSP 2*a*, and transmits to computation processing procedure holding units 12*b* a processing procedure that simultaneously sounds the do and mi of timbre 2 and the mi and sol of timbre 3 to be processed by DSP 2*b*.

In the processing that begins at step S8 each DSP generates and stores tones in accordance with the procedure in the corresponding computation unit processing procedure holding unit as has already been described above. The flowchart of FIG. 5 terminates as interrupt processing, such as if the power source of a device to which this tone generation device is installed is turned off.

In the embodiment described above, the amount of processing is computed from sheet music data and waveform data, and the amount of processing to be processed by each of DSPs 2*a* and 2*b* is determined from the sum total of the amount of processing that is computed, but the same processing can be done by including in the sheet music data, data of a processing procedure set from data by which the amount of processing is computed. In other words, when preparing the sheet music data, the sheet music is prepared as shown in FIG. 4, and when it is set to data to be read in by the tone generation device, the simultaneous tone emission number and interval changes have already been determined. Also set are the loudness changes that are to set the timbre and the compression method for waveform data (whether to have a high sound quality when played back). Therefore it is arranged so that when the sheet music data is prepared, the above four elements that control the sum total of the amount of processing are added in advance, data on the amount of processing is set, and processing procedures are written in.

Figure 6:
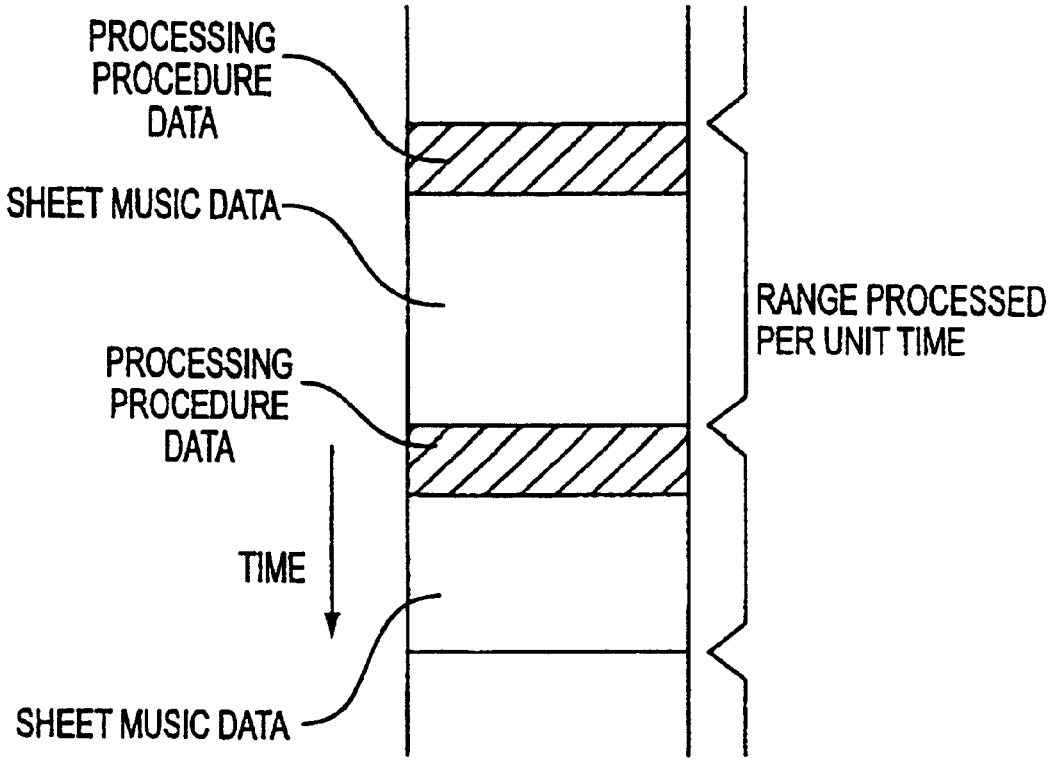
FIG. 6 is a diagram for explaining sheet music data that includes data on the amount of processing.

FIG. 6 is a diagram that models the sheet music data into which processing procedures are written. In this diagram, the vertical axis is the time axis, and one proceeds downward in the diagram as time passes. The crosshatched portion is data for the processing procedure, and the other parts are sheet music data.

Figure 7:
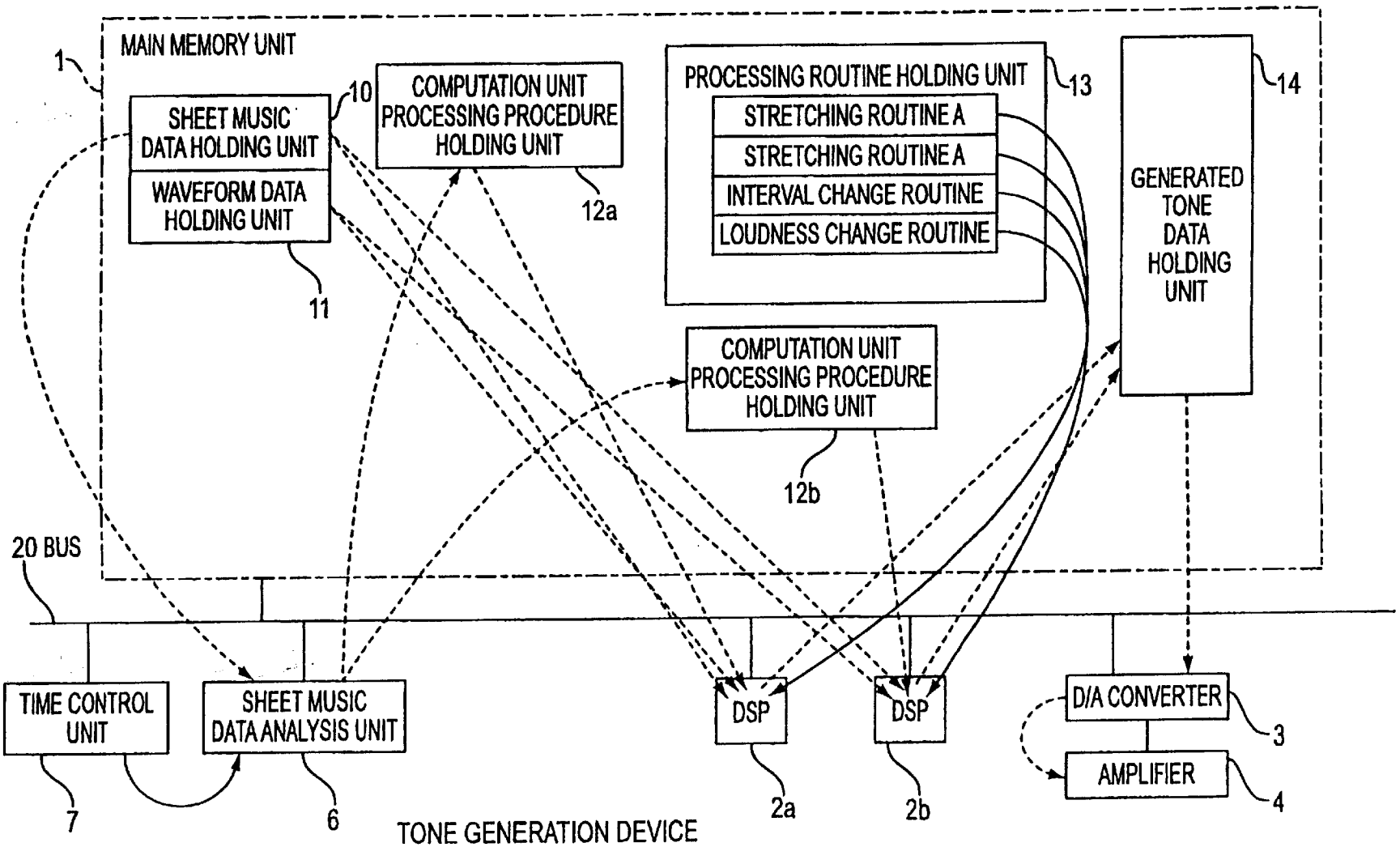
FIG. 7 is a block diagram of another embodiment of the tone generation device.

FIG. 7 shows a tone generation device that generates tones using sheet music data into which processing procedure data is thus written. The composition of the tone generation device shown in FIG. 7 is one in which computation unit processing allocation instruction unit 5 is deleted from the tone generation device shown in FIG. 3. Therefore sheet music data analysis unit 6 reads sheet music data such as is shown in FIG. 6 from sheet music data holding unit 10, and among this sheet music data, it transmits data on processing procedures to computation unit processing procedure holding units 12*a* and 12*b*.

The operation of the tone generation device shown in FIG. 7 will be described by referring to the flowchart of FIG. 8. First, in step S11, time control unit 7 instructs sheet music data analysis unit 6 concerning the timing for reading data from sheet music data holding unit 10. According to these instructions, sheet music data analysis unit 6 reads from sheet music data holding unit 10 data that has a data structure such as is shown in FIG. 6.

In step S12, among the read data, data concerning processing procedures is further read. In step S13, the reading pointer is moved to the start of the sheet music data to be read at the next timing.

In step S14, the processing procedure read in step S12 is transmitted to computation unit processing procedure holding units 12*a* and 12*b*. In step S15, DSPs 2*a* and 2*b* read the necessary data from sheet music data holding unit 10 and waveform data holding unit 11 and generate a tone in accordance with the processing procedure held in the corresponding computation unit processing procedure holding units 12*a* and 12*b*. Step S16 is not explained here, because it is the same processing as step S9 of FIG. 5.

In the above-described embodiment, we described the case in which two DSPs 2*a* and 2*b* are used as computation devices of computation unit 2, but this invention can be applied even if two or more DSPs are used, and needless to say, computation devices other than DSPs may be used. Also, computation devices having different processing capacities may be used. In addition, the computation of the amount of processing and the constants used for such computation are not limited to the above-described formulas and values; other formulas and values may also be used.

Figure 5:
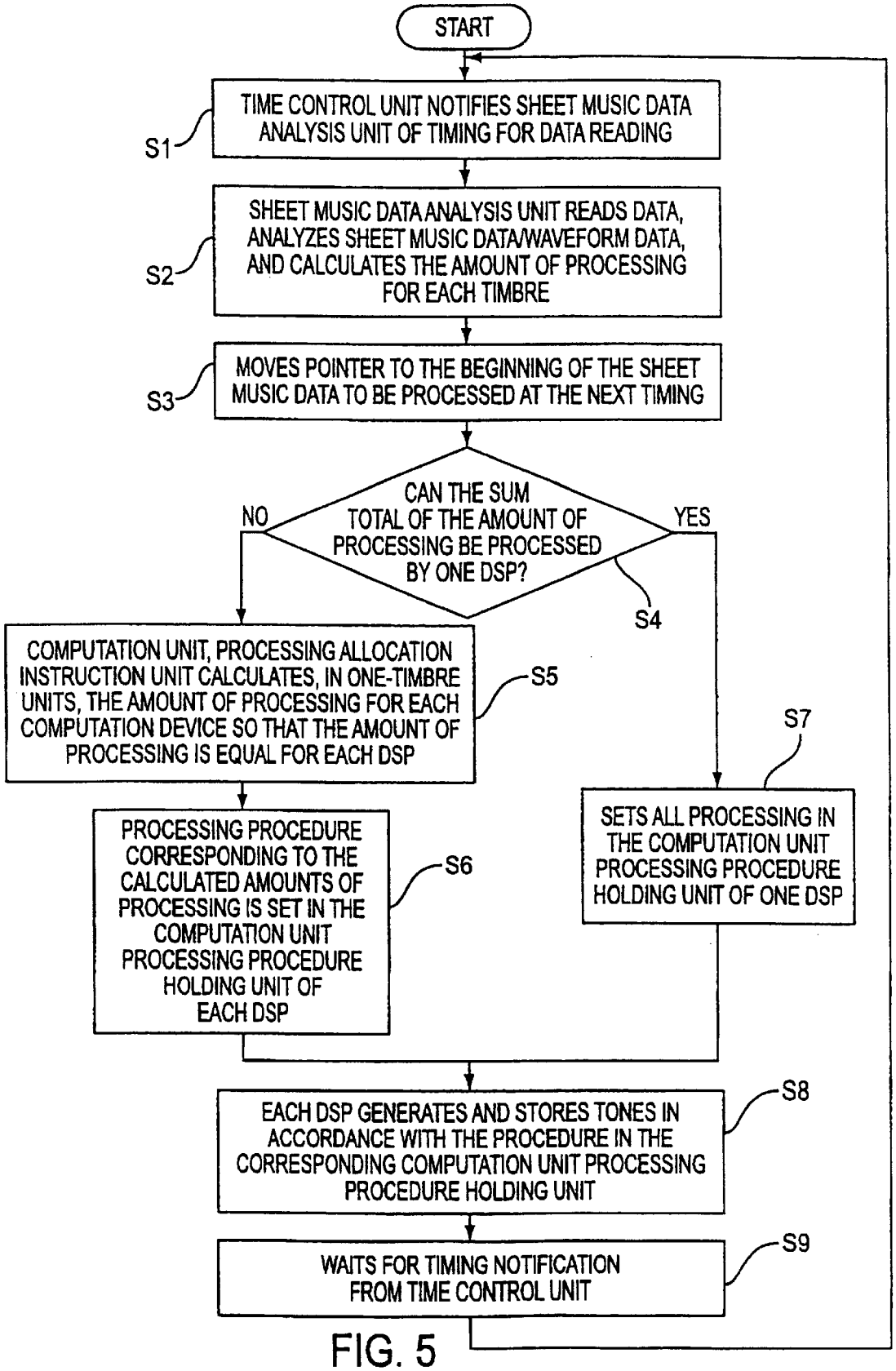
FIG. 5 is a flowchart of the operation of the tone generation device shown in FIG. 3.
Figure 8:
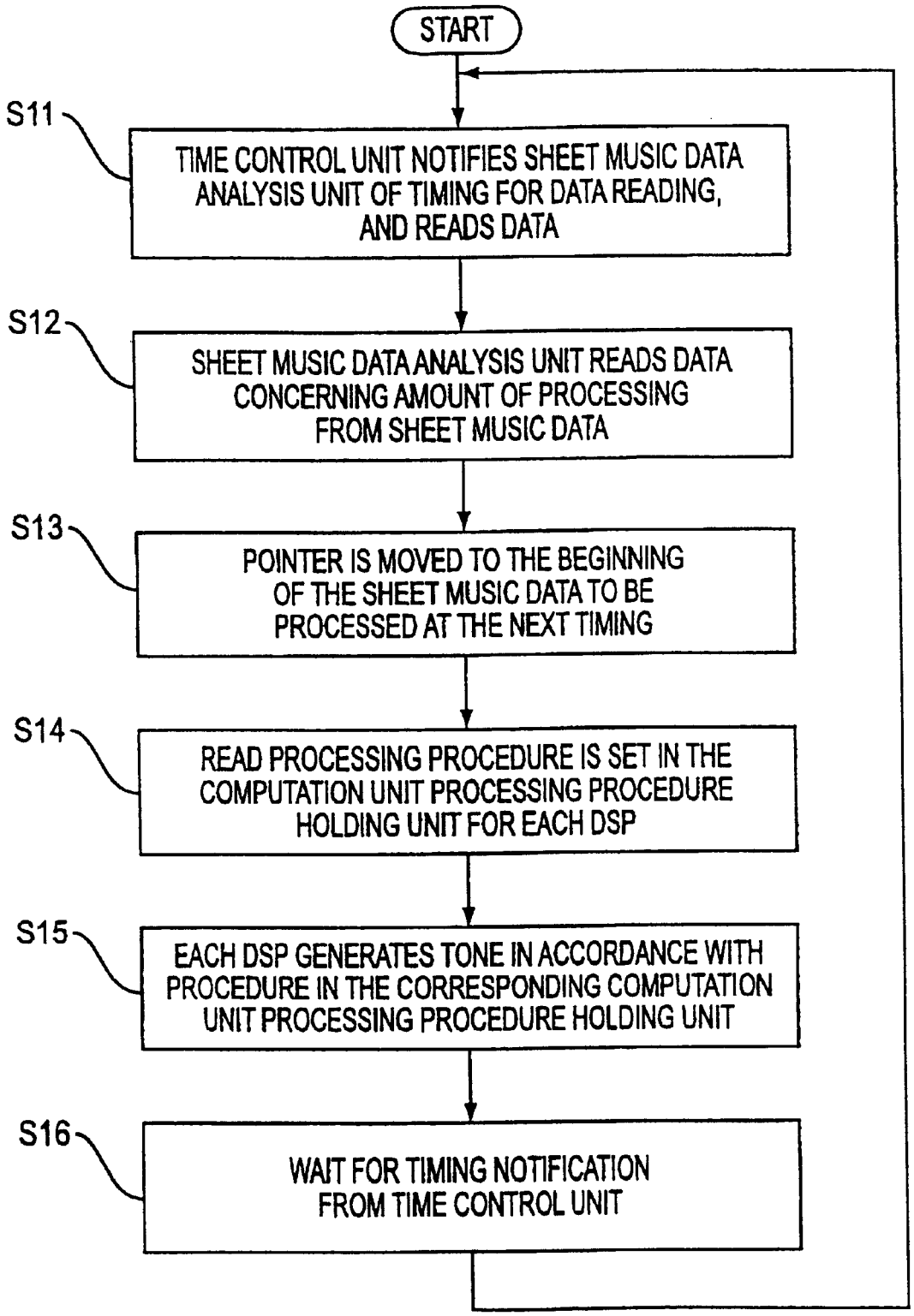
FIG. 8 is a flowchart for explaining the operation of the tone generation device of FIG. 7.

In the above description, the flowcharts shown in FIGS. 5 and 8 were described as repeated operations for every musical beat, but the repetition may be every 1/44100 second, which corresponds to a sampling frequency of 44.1 kHz.

In the above-described embodiment, we described a tone generation device, but this invention may be applied to other devices too.

In this specification, the distribution medium by which users are provided with computer programs that execute the above processing includes, besides information recording media such as magnetic disks and CD-ROMs, transmission media via networks, such as the Internet and digital satellites.

As described above, with the tone generation device, tone generation method, and distribution medium of the present invention, data for generating tones is read, the amount of processing needed for generating the tones of the read data is computed, and processing for generating tones in accordance with the computed amount of processing is apportioned to multiple devices for generating tones, thereby making it possible to efficiently process and generate tones with an amount of processing that matches the capacity of each generation means.

With the tone generation device, tone generation method, and distribution medium of the present invention, data describing the processing procedure assigned to each of multiple processing units determined based on the amount of processing of data for generating tones is read, and data for generating tones is read in accordance with the read processing procedures, thereby making it possible to efficiently process and generate tones with an amount of processing that matches the capacity of each generation means.

What is claimed is:

1. A tone generation device comprising:

a reading means that reads data for generating tones;

a computation means that computes the amount of processing needed to generate the tones of the data read by said reading means;

a plurality of tone generation means that generate tones;

an apportioning means that apportions the processing for generating tones to said plurality of tone generation means according to an amount of processing computed by said computation means; and a decision means that decides whether the amount of processing computed by said computation means can be processed by one of the tone generation means among said plurality of tone generation means, wherein if it is decided by said decision means that the amount of processing computed by said computation means is an amount that can be processed by one tone generation means, said apportioning means apportions all of said computed amount of processing to said one tone generation means, and if it is decided by said decision means that it is not an amount that can be processed by one tone generation means, the apportioning means apportions said computed amount of processing to said plurality of tone generation means in correspondence with the capacity of each tone generation means.

2. A tone generation method comprising:

a reading step that reads data for generating tones;

a computation step that computes an amount of processing needed to generate the tones of the data read in said reading step;

a plurality of tone generation steps that generate tones;

an apportioning step that apportions the processing for generating tones to said plurality of tone generation steps according to the amount of processing computed in said computation step; and a decision step that decides whether the amount of processing computed by said computation step can be processed by one of the tone generation step among said plurality of tone generation steps, wherein if it is decided by said decision step that the amount of processing computed by said computation step is an amount that can be processed by one tone generation step, said apportioning step apportions all of said computed amount of processing to said one tone generation step, and if it is decided by said decision step that it is not an amount that can be processed by one tone generation step, the apportioning step apportions said computed amount of processing to said plurality of tone generation steps in correspondence with the capacity of each tone generation step.

3. A distribution medium for providing a computer-readable program that causes a tone generation device to execute processing, comprising a reading step that reads data for generating tones, a computation step that computes an amount of processing needed to generate the tones of the data read in said reading step, a plurality of tone generation steps that generate tones, an apportioning step that apportions the processing for generating tones to said plurality of tone generation steps according to the amount of processing computed in said computation step, and a decision step that decides whether the amount of processing computed by said computation step can be processed by one of the tone generation step among said plurality of tone generation steps, wherein if it is decided by said decision step that the amount of processing computed by said computation step is an amount that can be processed by one tone generation step, said apportioning step apportions all of said computed amount of processing to said one tone generation step, and if it is decided by said decision step that it is not an amount that can be processed by one tone generation step, the apportioning step apportions said computed amount of processing to said plurality of tone generation steps in correspondence with the capacity of each tone generation step.

4. A tone generation device comprising:

a plurality of tone generation means that generate tones;

a first reading means that reads data describing the processing procedure assigned to each of said plurality of tone generation means determined based on the amount of processing of data for generating tones;

a second reading means that reads data for said tone generation means to generate tones in accordance with the processing procedure read by said first reading means; and a decision means that decides whether the data describing the processing procedure read by the first reading means can be processed by one of the tone generation means among said plurality of tone generation means, wherein if it is decided by said decision means that the data describing the processing procedure read by the first reading means can be processed by said one tone generation means, and if it is decided by said decision means that the data describing the processing procedure read by the first reading means cannot be processed by said one tone generation means, said second reading means reads data for said tone generation means to generate tones in accordance with the processing procedure read by said first reading means in correspondence with the capacity of each tone generation means.

5. A tone generation method comprising:

a plurality of tone generation steps that generate tones, a first reading step that reads data describing the processing procedure assigned to each in said plurality of tone generation steps determined based on the amount of processing of data for generating tones, a second reading step that reads data to generate tones in said tone generation steps in accordance with the processing procedure read in said first reading step, and a decision step that decides whether the data describing the processing procedure read by the first reading step can be processed by one of the tone generation steps among said plurality of tone generation steps, wherein if it is decided by said decision step that the data describing the processing procedure read by the first reading step can be processed by said one tone generation step, and if it is decided by said decision step that the data describing the processing procedure read by the first reading step cannot be processed by said one tone generation step, said second reading step reads data for said tone generation step to generate tones in accordance with the processing procedure read by said first reading step in correspondence with the capacity of each tone generation step.

6. A distribution medium for providing a computer-readable program that causes a tone generation device to execute processing, comprising:

a plurality of tone generation steps that generate tones;

a first reading step that reads data describing the processing procedure assigned to each in said plurality of tone generation steps determined based on the amount of processing of data for generating tones;

a second reading step that reads data to generate tones in said plurality of generation steps in accordance with the processing procedure read in said first reading step; and a decision step that decides whether the data describing the processing procedure read by the first reading step can be processed by one of the tone generation steps among said plurality of tone generation steps, wherein if it is decided by said decision step that the data describing the processing procedure read by the first reading step can be processed by said one tone generation step, and if it is decided by said decision step that the data describing the processing procedure read by the first reading step cannot be processed by said one tone generation step, said second reading step reads data for said tone generation step to generate tones in accordance with the processing procedure read by said first reading step in correspondence with the capacity of each tone generation step.

* * * * *